US008720544B2

(12) United States Patent
Xu

(10) Patent No.: US 8,720,544 B2
(45) Date of Patent: May 13, 2014

(54) ENHANCED PENETRATION OF TELESCOPING FRACTURING NOZZLE ASSEMBLY

(75) Inventor: Richard Yingqing Xu, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 349 days.

(21) Appl. No.: 13/114,858

(22) Filed: May 24, 2011

(65) Prior Publication Data

US 2012/0298781 A1 Nov. 29, 2012

(51) Int. Cl.
*E21B 43/112* (2006.01)

(52) U.S. Cl.
USPC ..... 166/177.5; 166/308.1; 166/305.1; 175/424; 239/281

(58) Field of Classification Search
None
See application file for complete search history.

(56) References Cited

U.S. PATENT DOCUMENTS

| | | | | |
|---|---|---|---|---|
| 3,784,112 | A * | 1/1974 | Collignon | 239/443 |
| 4,819,745 | A | 4/1989 | Walter | |
| 5,111,881 | A | 5/1992 | Soliman et al. | |
| 5,335,724 | A | 8/1994 | Venditto et al. | |
| 5,425,424 | A * | 6/1995 | Reinhardt et al. | 166/291 |
| 5,445,220 | A * | 8/1995 | Gurevich et al. | 166/55 |
| 5,484,016 | A | 1/1996 | Surjaatmadja et al. | |
| 5,494,103 | A | 2/1996 | Surjaatmadja et al. | |
| 5,499,678 | A | 3/1996 | Surjaatmadja et al. | |
| 5,533,571 | A | 7/1996 | Surjaatmadja et al. | |
| 5,765,756 | A * | 6/1998 | Jordan et al. | 239/204 |
| 6,626,253 | B2 | 9/2003 | Hahn et al. | |
| 6,662,874 | B2 | 12/2003 | Surjaatmadja et al. | |
| 6,719,054 | B2 | 4/2004 | Cheng et al. | |
| 6,725,933 | B2 | 4/2004 | Middaugh et al. | |
| 6,779,607 | B2 | 8/2004 | Middaugh et al. | |
| 6,938,690 | B2 | 9/2005 | Surjaatmadja | |
| 7,017,665 | B2 | 3/2006 | Nguyen | |
| 7,159,660 | B2 | 1/2007 | Justus | |
| 7,225,869 | B2 | 6/2007 | Willett et al. | |
| 7,237,612 | B2 | 7/2007 | Surjaatmadja et al. | |
| 7,278,486 | B2 | 10/2007 | Alba et al. | |
| 7,337,844 | B2 | 3/2008 | Surjaatmadja et al. | |
| 7,343,974 | B2 | 3/2008 | Cowan | |
| 7,681,635 | B2 | 3/2010 | Farabee et al. | |
| 2008/0083531 | A1 | 4/2008 | Surjaatmadja | |
| 2009/0107680 | A1 | 4/2009 | Surjaatmadja | |
| 2009/0283260 | A1 | 11/2009 | Surjaatmadja et al. | |
| 2011/0308803 | A1 * | 12/2011 | O'Connell et al. | 166/308.1 |

* cited by examiner

*Primary Examiner* — Jennifer H Gay
*Assistant Examiner* — Caroline Butcher
(74) *Attorney, Agent, or Firm* — Steve Rosenblatt

(57) ABSTRACT

A fracturing jet nozzle assembly has nested telescoping sections that each have nozzles in them. The outermost stage makes for a large perforation as it and the adjacent stages begin extension. As the stage adjacent the outermost stage continues to extend into the perforation and reaches maximum extension the nozzles in the outermost stage are cut off from fracturing fluid flow and that flow is in turn redirected to the remaining stages that have not yet fully extended. The innermost stage preferably does not get cut off from jet fluid flow even at its full extension.

20 Claims, 4 Drawing Sheets

ENHANCED PENETRATION OF TELESCOPING FRACTURING NOZZLE ASSEMBLY

FIELD OF THE INVENTION

The field of the invention is nozzles used in formation fracturing and more particularly nozzles used to enhance the initiation and propagation of formation fractures by adding a feature of continuing extension during fracturing and diverting fracture flow away from extended portions and into portions still capable of further extension.

BACKGROUND OF THE INVENTION

Fracturing in open hole is a complex subject and has been studied and written about by various authors. Whether using explosives or fluid jets one of the problems with the initiated fractures is in the way they propagate. If the propagation pattern is more tortuous as the fractures emanate from the borehole an undesirable condition called screenout can occur that can dramatically decrease the well productivity after it is put on production.

Hydraulically fracturing from any borehole in any well orientation is complex because of the earth's ambient stress field operating in the area. This is complicated further because of the extreme stress concentrations that can occur along the borehole at various positions around the well. For instance, there are positions around the borehole that may be easier to create a tensile crack than other positions where extreme compressive pressures are preventing tensile failure. One way that has been suggested to minimize this condition is to use jets that create a series of fan shaped slots in the formation with the thinking that a series of coplanar cavities in the formation will result in decreased tortuosity. This concept is discussed in SPE 28761 Surjatmaadja, Abass and Brumley Elimination of Near-wellbore Tortuosities by Means of Hydrojetting (1994). Other references discus creating slots in the formation such as U.S. Pat. Nos. 7,017,665; 5,335,724; 5,494,103; 5,484,016 and US Publication 2009/0107680.

Other approaches oriented the jet nozzles at oblique angles to the wellbore to try to affect the way the fractures propagated. Some examples of such approaches are U.S. Pat. Nos. 7,159,660; 5,111,881; 6,938,690; 5,533,571; 5,499,678 and US Publications 2008/0083531 and 2009/0283260.

Other approaches involved some form of annulus pumping in conjunction with jet fracturing. Some examples of this technique are U.S. Pat. Nos. 7,278,486; 7,681,635; 7,343,974; 7,337,844; 7,237,612; 7,225,869; 6,779,607; 6,725,933; 6,719,054 and 6,662,874.

Pulsing techniques have been used in jet drilling or in conventional drilling to pulse the bit nozzle flow as described in U.S. Pat. Nos. 4,819,745 and 6,626,253. Also related to these applications is SPE paper 130829-MS entitled *Hydraulic Pulsed Cavitating Jet Assisted Deep Drilling: An Approach to Improve Rate of Penetration.*

Jets mounted to telescoping assemblies have been suggested with the idea being that if the jet is brought closer to the formation the fracturing performance will improve. This was discussed in U.S. application Ser. No. 12/618,032 filed Nov. 13, 2009 called Open Hole Stimulation with Jet Tool and is commonly assigned to Baker Hughes Inc. In another variation of telescoping members used for fracturing the idea was to extend the telescoping members to the borehole wall and to set spaced packers in the annulus so as to avoid the need to cement and to allow production from the telescoping members after using some of them to initially fracture the formation. This was discussed in U.S. application Ser. No. 12/463,944 filed May 11, 2009 and entitled Fracturing with Telescoping Members and Sealing the Annular Space and is also commonly assigned.

The present invention seeks to improve the extent of the fracturing that is accomplished beyond the initial formation perforation that is initiated explosively or with a direct impingement nozzle. This is accomplished with a telescoping assembly that directs jet streams from each stage. As the largest stage extends fully the flow of fracturing fluid to it is cut off and redirected to the smaller stages that it surrounds. In turn as the perforation grows from jet impingement some portion of the assembly can continue to extend to keep the gap distance from the nozzle face to the depth of the perforation to a minimum so as to improve the starting and propagating of fractures.

SUMMARY OF THE INVENTION

A fracturing jet nozzle assembly has nested telescoping sections that each has nozzles in them. The outermost stage makes for a large perforation as it and the adjacent stages begin extension. As the stage adjacent the outermost stage continues to extend into the perforation and reaches maximum extension the nozzles in the outermost stage are cut off from fracturing fluid flow and that flow is in turn redirected to the remaining stages that have not yet fully extended. The innermost stage preferably does not get cut off from jet fluid flow even at its full extension.

DETAILED DESCRIPTION OF THE PREFERRED EMBODIMENT

Figure 1:
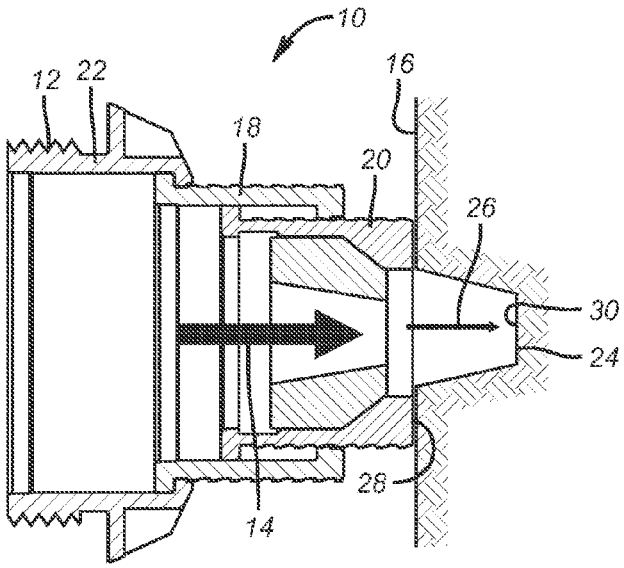
(PRIOR ART) FIG. 1
FIG. 1 is a section view of a current telescoping frac nozzle design.
Figure 2:
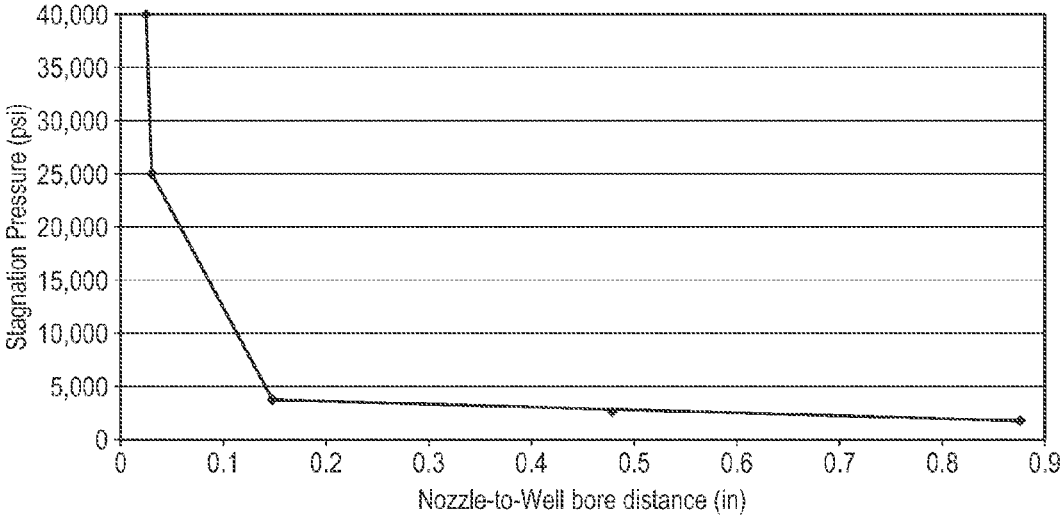
FIG. 2 is a graph showing the relationship of nozzle to wellbore distance to stagnation pressure.

FIG. 1 illustrates the problem to be overcome by the present invention in a telescoping fracturing nozzle 10 that can be secured with threads 12 to an opening in a tubular string (not shown) so that a jet of fluid represented by arrow 14 can result in telescoping action to the borehole wall 16. The force of the flowing fluid represented by arrow 14 causes the sliding stages 18 and 20 to slide out toward the borehole wall 16. Stage 22 is fixed to the tubular that is not shown. The perforation 24 is not there initially when the stages 18 and 20 extend and it is the force of the jet fluid stream represented by arrow 26 that forms the perforation 24. As the jetting continues and the perforation 24 gets bigger the distance from the nozzle face 28 and the deep end 30 of the perforation 24 increases. Looking at the graph of FIG. 2 it is easy to see how the stagnation pressure in the perforation 24 will exponentially decline when the distance from the nozzle to the perforation bottom at 30 increases.

The present invention deals with this issue in a way that allows the nozzle to telescope as the perforation gets larger during the fracturing process. Using nozzles in the adjacent outer stages to enlarge the perforation to make further stage extension possible the apparatus also cuts off jet fluid to fully advanced stages as the next stage inboard goes to full extension. In this manner the outermost stage with jet flow makes the perforation larger to enable the adjacent stages that are inboard to advance as the perforation grows. As the next stages advance they also direct a larger flow to the now enlarged perforation to further aid the stages that have not yet fully advanced to further do so. The innermost stage that is generally coincident with the axis of the assembly sees a continuous flow to full extension without flow cutoff. The detailed explanation for how the above is accomplished is illustrated in detail below with regard to FIGS. 3-8.

Figure 3:
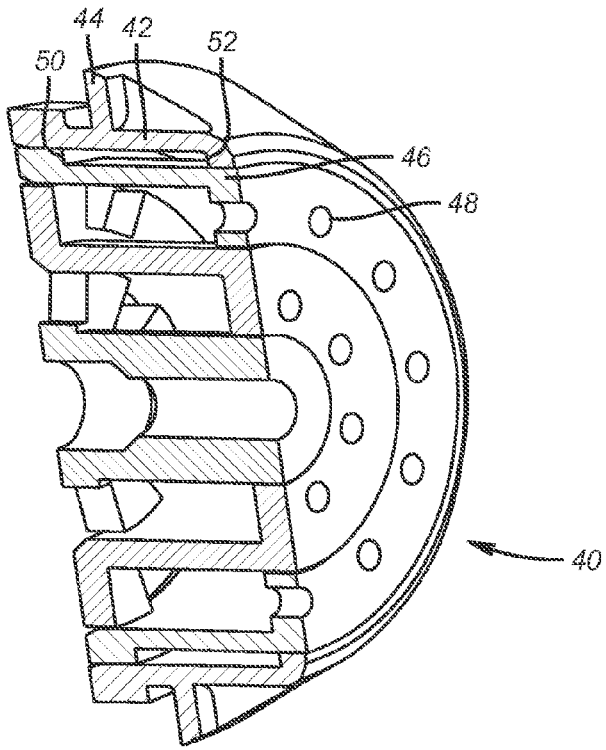
FIG. 3 is a perspective cutaway view of half the nozzle assembly before the onset of flow.
Figure 4:
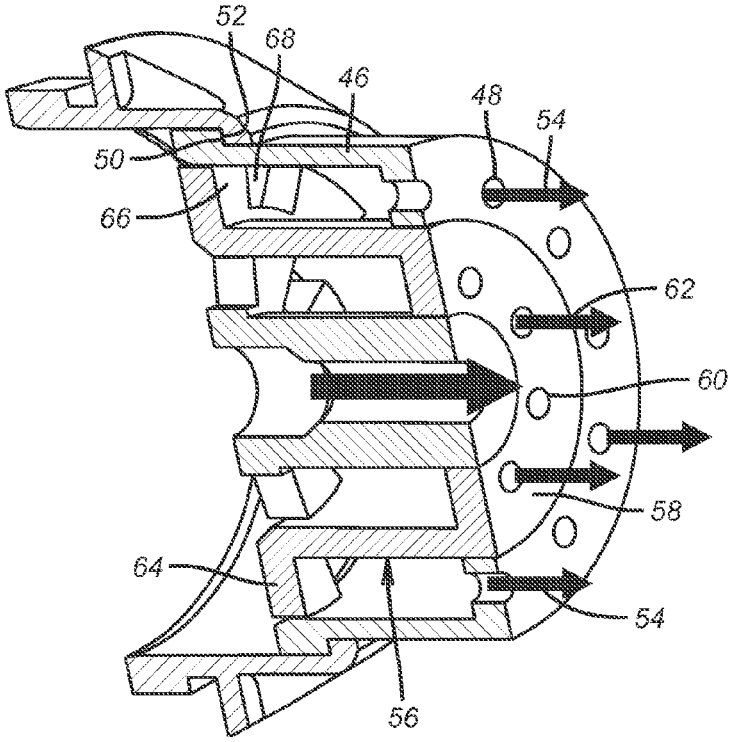
FIG. 4 the view of FIG. 3 with flow initiated and all stages moving an identical initial distance to reach the formation.
Figure 5:
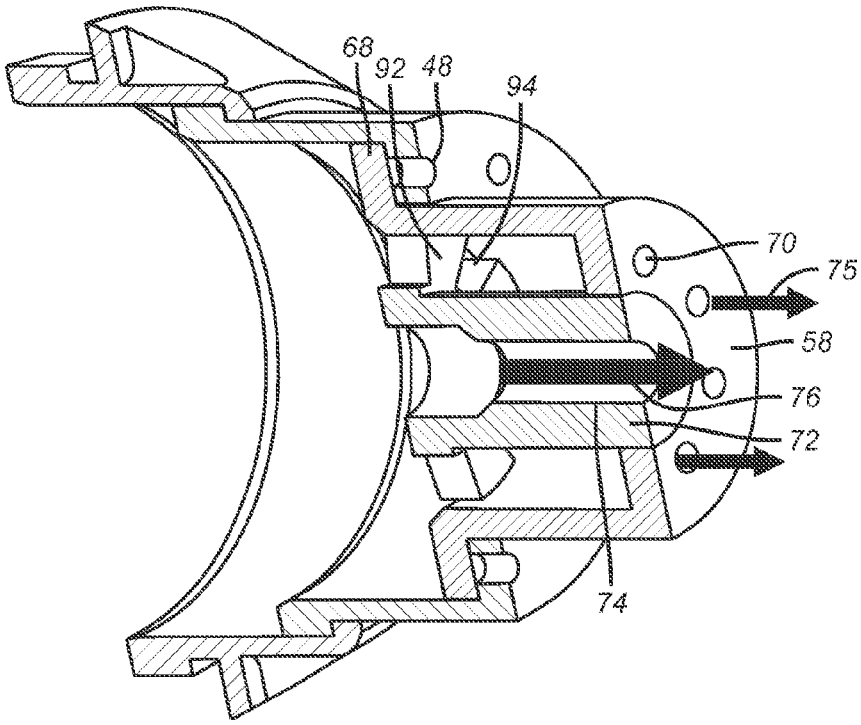
FIG. 5 is the view of FIG. 4 with the intermediate stage fully extended cutting off jet flow to the outer stage that is also fully extended.
Figure 6:
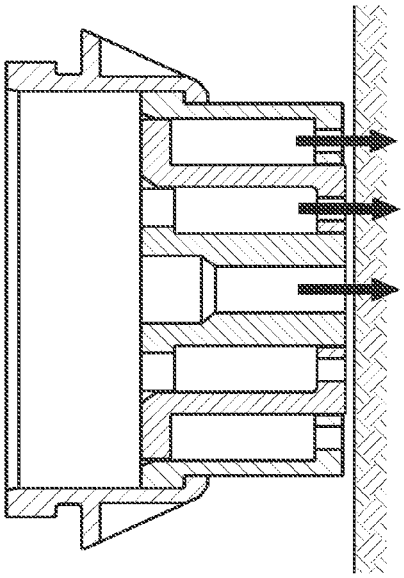
FIG. 6 is a side view of FIG. 4 showing all the stages initially extended to adjacent the borehole wall.

FIG. 3 shows the run in position of a nozzle assembly 40. There is an outer housing 42 with a mounting flange 44 that is sealingly secured to an opening in a tubular string that is not shown. An outermost stage 46 has openings 48 that are preferably equally spaced on a common radius. When travel stop 50 hits shoulder 52 of outer housing 42, the outer travel limit of stage 46 is reached, as shown in FIG. 4. As shown in FIG. 4 arrows 54 represent jet flow through stage 46 that continues despite the full extension of stage 46 as the stop 50 hits shoulder 52. Nested within stage 46 is intermediate stage 56 that has an outer annular shape 58 with an array of nozzles 60 that are preferably equally spaced on a common radius with arrows 62 representing the jet flow through nozzles 60. At the inner end of the intermediate stage 56 is a segmented flange ring 64 that is made of alternating tabs 66 and gaps 68. The stages 56 and 46 can be optionally locked against relative rotation while still optionally be placed in the outer housing 42 in a way that the stages can all rotate in tandem. Axial advancing of the intermediate stage 56, when the outer stage 46 is fully extended, brings the tabs 66 in contact with nozzles 48 as shown in FIG. 5. When that happens, flow to the nozzles 48 is cut off but is redirected to nozzles 70 on the leading face 58 of the intermediate stage 56. At the same time there is also an increase in flow through the inner stage 72 through its central nozzle 74. In FIG. 5 the enhanced flow through the intermediate stage 56 and the inner stage 72 is represented respectively by the arrows 75 and 76.

Figure 7:
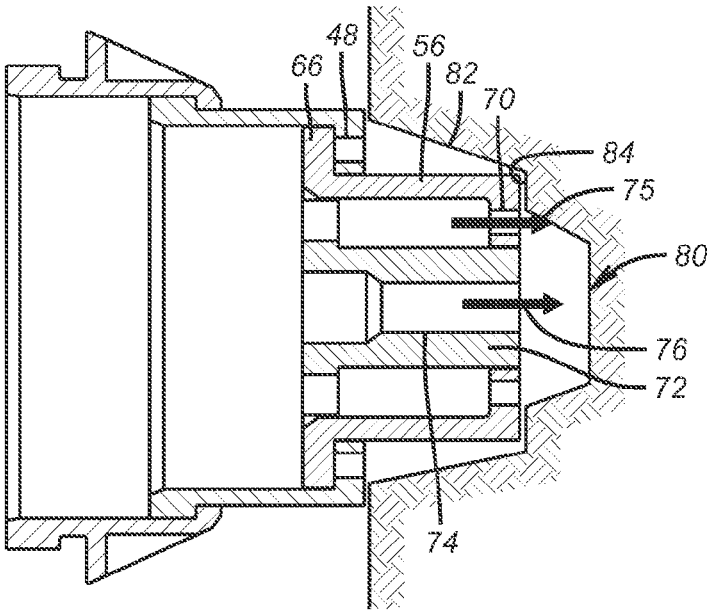
FIG. 7 is the view of FIG. 6 with the outer stage fully extended and the perforation enlarged to allow the middle stage to further extend and cut the jet flow to the outer stage.

FIG. 7 is a side view of FIG. 5 showing the flow through the intermediate stage 56 and the inner stage 72. The perforation 80 has already been enlarged at its outer periphery 82 and the flow to nozzles 48 has been cut off by the tabs 66. The intermediate stage 56 has been able to advance to full extension to near the perforation surface 84 as flow through the intermediate stage 56 continues as indicated by arrow 75 through nozzles 70. That flow continues to enlarge the perforation 80 to create another and deeper shoulder 86 whose formation is assisted by the enhanced flow through nozzle 74 as indicated by arrow 76.

Figure 8:
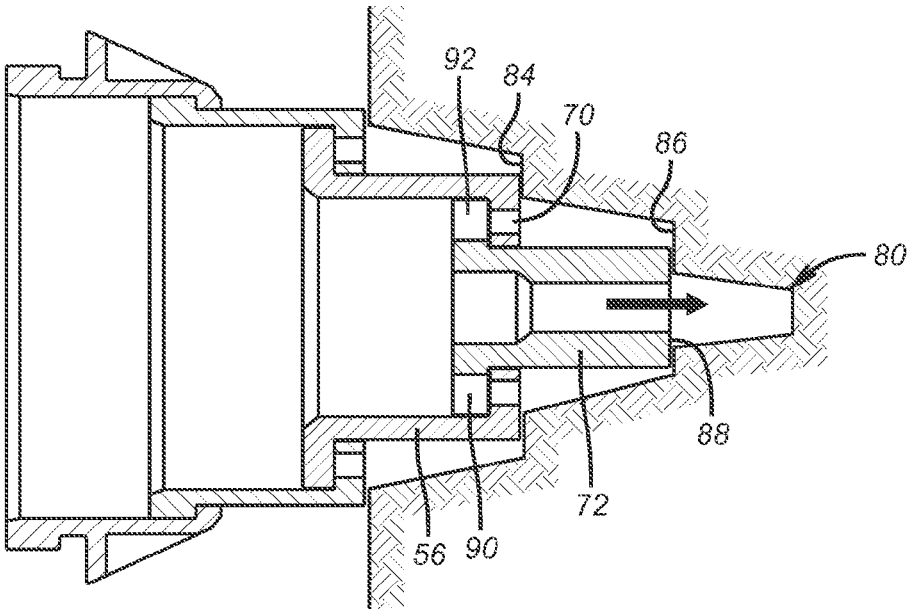
FIG. 8 is the view of FIG. 7 with the middle and inner stages fully extended cutting off the jetting flow to the middle stage.

The inner stage 72 has a front face 88 and a rear segmented flange 90 that has alternating tabs 92 and gaps 94 as seen in FIG. 5. As seen in FIG. 8 when the tabs 92 contact the nozzles 70 in the intermediate stage 56 then the flow to nozzles 70 is cut off and the flow to the inner stage 72 through its nozzle 74 is enhanced. The stages 56 and 72 can be locked optionally against relative rotation but can still be allowed to rotate in tandem relative to the outer stage 46 or relative to the outer housing 42 such as when all the stages turn together. FIG. 8 represents the full extension of all the stages with the shoulder 86 still not contacted by the front face 88 of the inner stage 72. It is also possible that at the end of the fracturing process that all the stages have not fully extended notably the inner stage 72. It is also possible that more inboard stages can extend before stages that surround them extend. As the perforation 80 enlarges it will allow innermost stages to extend even if the outer stages are held back from full extension. As the perforation 80 changes shape the outer stages may then extend.

Variations on the preferred embodiment are also envisioned. While three stages are described, two or more stages can be used. The nozzle pattern on any specific stage can have unequal spacing on a common radius or use of a single or multiple rows of nozzles or a random placement of the nozzles on any particular stage. The stages can be built out of a hardened material or the nozzles themselves can be hardened inserts in a stage built out of a softer material where the inserts are supported in the outer wall of the stage or with a flange internally to the stage to hold the insert in position with flow running through the insert. While the use of tabs that advance to cover the nozzles in the surrounding stage are preferred other devices that shut off flow to an exterior stage when the next adjacent stage gets to maximum extension are also contemplated. While the interior stage 72 is illustrated with a single nozzle 74 with a common axis to the axis of the other stages, it can also have multiple nozzles in an ordered or random spacing. While the nozzles in the various stages have been shown on exes that are parallel to the axis of the overall assembly, the orientation of the nozzle axes can be askew in more than a single plane or one plane to the axis of the assembly so that the nozzle axis may not even intersect with the axis of the assembly so as to cause one or more of the stages to rotate as the jet stream exits so as to deliver a pulsating impact to a particular location in the perforation to enhance the initiation and propagation of fractures from the perforation. Ratchet devices can be used to prevent any retraction of stages after extension.

The above description is illustrative of the preferred embodiment and many modifications may be made by those skilled in the art without departing from the invention whose scope is to be determined from the literal and equivalent scope of the claims below.

I claim:

1. A telescoping nozzle assembly for placement at a subterranean location for fracturing a borehole wall at a subterranean location, comprising:

a housing having at least one wall opening thereon;

a nozzle body in said at least one opening further comprising a plurality of stages relatively movable to each other in response to fluid pressure delivered to a passage therein said passage in said stages extending to respective distal ends located closest to the borehole wall;

at least two said stages further comprising at least one opening at said distal end comprising a nozzle thereon to selectively direct fracturing pressurized fluid against the borehole wall.

2. The assembly of claim 1, wherein:

movement of one said stage relative to another said stage blocks at least one nozzle on one of said stages.

3. The assembly of claim 2, wherein:

said stages are nested.

4. The assembly of claim 3, wherein:

at least one stage further comprises a travel stop that engages an adjacent stage to stop relative movement between said one stage and said adjacent stage.

5. The assembly of claim 4, wherein:
said travel stop cuts flow to at least one nozzle in an adjacent stage when engaging said adjacent stage.

6. The assembly of claim 5, wherein:
said adjacent stage radially surrounds said one stage.

7. The assembly of claim 6, wherein:
said one stage has fully extended before said travel stop of said adjacent stage makes contact to shut off at least one said nozzle.

8. The assembly of claim 5, wherein:
said travel stop comprises a segmented ring with tabs spaced apart by gaps.

9. The assembly of claim 8, wherein:
said tabs are aligned with nozzles in an adjacent stage to cut off flow to said nozzles when abutting said nozzles.

10. The assembly of claim 9, wherein:
said stages are concentrically mounted about a common axis and at least one nozzle on at least one stage has a nozzle axis askew with respect to said common axis.

11. The assembly of claim 10, wherein:
at least one nozzle on at least one stage has a nozzle axis that does not intersect said common axis.

12. The assembly of claim 11, wherein:
said stages move relatively and radially toward the borehole wall as flow through said nozzles moves the borehole wall away by creating or enlarging a perforation in the wall.

13. The assembly of claim 12, wherein:
said stages are retained by an outer housing that provides a travel stop for extension of the stage immediately adjacent.

14. The assembly of claim 1, wherein:
said stages are retained by an outer housing and at least one said stage is rotatably mounted with respect to said housing.

15. The assembly of claim 14, wherein:
said stages are all mounted for tandem rotatable movement with respect to said housing.

16. The assembly of claim 1, wherein:
said stages are concentrically mounted about a common axis and at least one nozzle on at least one stage has a nozzle axis askew with respect to said common axis.

17. The assembly of claim 16, wherein:
at least one nozzle on at least one stage has a nozzle axis that does not intersect said common axis.

18. The assembly of claim 1, wherein:
said stages are retained by an outer housing that provides a travel stop for extension of the stage immediately adjacent.

19. The assembly of claim 18, wherein:
said stages comprise an innermost stage to a common axis for said stages that further comprises at least one nozzle that is not shut off on extension of said innermost stage relative to an adjacent surrounding stage.

20. The assembly of claim 1, wherein:
said stages move relatively and radially toward the borehole wall as flow through said nozzles moves the borehole wall away by creating or enlarging a perforation in the wall.

* * * * *